US005725095A

United States Patent [19]

Beck et al.

[11] Patent Number: 5,725,095

[45] Date of Patent: Mar. 10, 1998

[54] GOLF BAG WITH PUTTER WELL AND LIFT HANDLE

[75] Inventors: Edwin Beck, Boston; Chuck Heidenreich, Westfield, both of Mass.

[73] Assignee: Lisco, Inc., Tampa, Fla.

[21] Appl. No.: 667,158

[22] Filed: Jun. 20, 1996

[51] Int. Cl.[6] ..... A63B 55/00

[52] U.S. Cl. ..... 206/315.8; 206/315.3

[58] Field of Search ..... 206/315.3, 315.6, 206/315.8; 116/125, 127; 383/25

[56] References Cited

U.S. PATENT DOCUMENTS

| | | | |
|---|---|---|---|
| Re. 33,203 | 4/1990 | Reimers . | |
| 1,483,475 | 2/1924 | Osterhoudt | 206/315.6 |
| 2,508,264 | 8/1950 | Johnson . | |
| 3,473,187 | 10/1969 | Schreyer et al. | 16/125 |
| 3,559,709 | 2/1971 | Seibold . | |
| 3,799,227 | 3/1974 | Cantwell | 206/315.3 X |
| 4,106,678 | 8/1978 | Thomas . | |
| 4,596,328 | 6/1986 | Solheim . | |
| 4,600,100 | 7/1986 | Solheim . | |
| 4,667,820 | 5/1987 | Solheim . | |
| 4,685,561 | 8/1987 | Reimers . | |
| 4,796,752 | 1/1989 | Reimers . | |
| 4,844,253 | 7/1989 | Reimers . | |
| 4,881,638 | 11/1989 | Cho . | |
| 4,932,523 | 6/1990 | Yamazoe . | |
| 4,955,472 | 9/1990 | Yamazoe . | |
| 4,995,510 | 2/1991 | Fletcher . | |
| 5,042,654 | 8/1991 | Jones . | |
| 5,088,600 | 2/1992 | Kopp . | |
| 5,103,974 | 4/1992 | Antonious . | |
| 5,125,507 | 6/1992 | Graziano, Jr. | 206/315.6 |
| 5,283,137 | 2/1994 | Ching | 16/125 X |
| 5,290,104 | 3/1994 | Sengewald | 383/25 |
| 5,303,888 | 4/1994 | Seop | 206/315.6 |
| 5,311,987 | 5/1994 | Shin . | |
| 5,332,090 | 7/1994 | Tucker . | |
| 5,431,278 | 7/1995 | Gretz | 206/315.6 |
| 5,445,267 | 8/1995 | Biafore, Jr. | 206/315.8 |

*Primary Examiner*—Christopher J. McDonald

[57] ABSTRACT

A golf bag comprising a top formed in a generally cylindrical configuration with a lower surface and an upper surface. The top is formed with spacers forming openings and with a smaller front opening constituting a generally triangular putter well. The lower surface of the top is formed with at least one downwardly facing recess. A bottom is formed in a generally cylindrical configuration with a lower surface and with a peripheral wall terminating in an upper surface. The upper surface of the bottom is formed with at least one upwardly facing recess in alignment with the downwardly facing recess of the top. The bottom has a rearwardly extending wall adjacent to the lower surface and an aperture therethrough for constituting a handle. An exterior cover has an upper edge coupled over the periphery of the top adjacent to its lower surface and coupled over the periphery of the bottom adjacent to its upper surface. At least one essentially rigid support is provided with an upper end received within the downwardly facing recess of the top and with a lower end received within the upwardly facing recess of the bottom.

5 Claims, 6 Drawing Sheets

GOLF BAG WITH PUTTER WELL AND LIFT HANDLE

BACKGROUND OF THE INVENTION

1. Field of the Invention

The present invention relates to a golf bag and more particularly pertains to a golf bag with a putter well and a lift handle.

2. Description of the Prior Art

The use of golf bags of a wide variety of designs and configurations is known in the prior art. More specifically, golf bags of a wide variety of designs and configurations heretofore devised and utilized for the purpose of attempting to simplify the usage of golf bags through various methods and apparatuses are known to consist basically of familiar, expected, and obvious structural configurations, notwithstanding the myriad of designs encompassed by the crowded prior art which has been developed for the fulfillment of countless objectives and requirements. By way of example:

1. U.S. Pat. No. 2,508,264 to Johnson, unassigned on its face, discloses a golf club case.

2. U.S. Pat. No. 3,559,709 to Seibold, unassigned on its face, discloses a golf bag.

3. U.S. Pat. No. 4,106,678 to Thomas, assigned to Tatco Inc., discloses a golf ball and tee caddy.

4. U.S. Pat. No. 4,596,328 to Solheim, unassigned on its face, discloses a throat structure for golf club bags.

5. U.S. Pat. Nos. 4,600,100 and 4,667,820 to Solheim, unassigned on their face, disclose a throat structure for golf club bags.

6. U.S. Pat. Nos. 4,796,752 and 4,844,253 to Reimers, unassigned on their face, disclose a cart bag for golf.

7. U.S. Pat. No. 4,881,638 to Cho, assigned to Haidon Industrial Co., Ltd., discloses a golf bag with divider and putter housing.

8. U.S. Pat. No. 4,932,523 to Yamazoe, assigned to Wataru Yamazoe, Takshiro Yamazoe, Makiko Yamazoe and Yuriko Yamazoe, discloses a protective box-shaped tube for inserting a golf club into a golf bag.

9. U.S. Pat. No. 4,955,472 to Yamazoe, assigned to Wataru Yamazoe, Takshiro Yamazoe, Makiko Yamazoe and Yuriko Yamazoe, discloses a golf bag with a club securing device.

10. U.S. Pat. No. 4,995,510 to Fletcher, Jr., unassigned on its face, discloses a club-separating insert system for golf bags.

11. U.S. Pat. No. 5,088,600 to Kopp, Jr., unassigned on its face, discloses a golf club shaft protector tube.

12. U.S. Pat. No. 5,103,974 to Antonious, unassigned on its face, discloses an adjustable golf club holder insert.

13. U.S. Pat. No. 5,311,987 to Shin, unassigned on its face, discloses a golf bag with form organizer.

14. U.S. Pat. No. 5,332,090 to Tucker, assigned to Wm. T. Burnett & Co., discloses a golf putter holder.

15. U.S. Pat. No. 4,685,561 and Re. Pat. No. 33,203 to Reimers, unassigned on their face, disclose a golf bag device.

16. U.S. Pat. No. 5,042,654 to Jones, assigned to Jones Sports Co., discloses a golf bag having hand grips in its base.

In this respect, the golf bag with putter well and lift handle according to the present invention substantially departs from the conventional concepts and designs of the prior art, and in doing so provides an apparatus primarily developed for the purpose of conveniencing a golfer during the handling of a putter and the transportation of the bag.

Therefore, it can be appreciated that there exists a continuing need for a new and improved golf bag with putter well and lift handle which can be used for conveniencing a golfer during the handling of a putter and the transportation of the golf bag. In this regard, the present invention substantially fulfills this need.

SUMMARY OF THE INVENTION

In view of the foregoing disadvantages inherent in the known types of golf bags of a wide variety of designs and configurations now present in the prior art, the present invention provides an improved golf bag with putter well and lift handle. As such, the general purpose of the present invention, which will be described subsequently in greater detail, is to provide a new and improved golf bag with putter well and lift handle and method which has all the advantages of the prior art and none of the disadvantages.

To attain this, the present invention relates to a new and improved golf bag with a putter well in the top and a handle in the bottom comprising, in combination, a top formed of a thermoplastic rubber in a generally cylindrical configuration with a generally flat lower surface and a centrally raised upper surface and with the periphery being smaller adjacent to the lower surface than adjacent to the upper surface, the top being formed with lateral spacers and a longitudinal spacer forming a rear opening, two intermediate openings and a major front opening at a generally common elevation and a smaller front opening at a lower elevation constituting a generally triangular putter well adjacent to one side thereof, the lower surface of the top being formed with five downwardly facing cylindrical apertures and with a downwardly extending elongated recess in the spacers; a bottom formed of polyethylene in a generally cylindrical configuration with a generally flat lower surface and a peripheral wall terminating in a generally flat upper surface and with the periphery being smaller adjacent to the upper surface than adjacent to the lower surface, the upper surface of the bottom being formed with a five upwardly facing cylindrical apertures in axial alignment with the downwardly facing cylindrical apertures of the top, the bottom having a rearwardly extending trapezoidal wall adjacent to the lower surface with vertical undulations on its exterior face and an aperture therethrough for constituting a handle, the handle having a vertical rod coupling the center of the handle with an adjacent region in the bottom; a cloth exterior cover in a generally cylindrical configuration having an upper edge coupled over the periphery of the top adjacent to its lower surface and coupled over the periphery of the bottom adjacent to its upper surface; an interior fabric liner having an upper edge folded over and secured within the downwardly extending elongated recesses of the top and secured to the bottom with fasteners to define, within the exterior cover, a plurality of compartments; and five essentially rigid rods with upper ends received within the downwardly facing cylindrical recesses of the top and with lower ends received within the upwardly facing cylindrical recesses of the bottom.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf bag with putter well and lift handle which has all the advantages of the prior art golf bags of a wide variety of designs and configurations and none of the disadvantages.

It is another object of the present invention to provide a new and improved golf bag with putter well and lift handle which may be easily and efficiently manufactured and marketed.

It is a further object of the present invention to provide a new and improved golf bag with putter well and lift handle which is of durable and reliable constructions.

It is a further object of the present invention to maintain the balance of a golf bag through the positioning of a handle adjacent to the rear and a putter well adjacent to the front.

An even further object of the present invention is to provide a new and improved golf bag with putter well and lift handle which is susceptible of a low cost of manufacture with regard to both materials and labor, and which accordingly is then susceptible of low prices of sale to the consuming public, thereby making such golf bag with putter well and lift handle economically available to the buying public.

Even still another object of the present invention is to provide an improved golf bag for conveniencing a golfer during the handling of a putter and the transportation of the bag.

Lastly, it is an object of the present invention to provide a new and improved golf bag comprising a top formed in a generally cylindrical configuration with a lower surface and an upper surface, the top being formed with spacers forming openings and with a smaller front opening constituting a generally triangular putter well, the lower surface of the top being formed with at least one downwardly facing recess means; a bottom formed in a generally cylindrical configuration with a lower surface and with a peripheral wall terminating in an upper surface, the upper surface of the bottom being formed with at least one upwardly facing recess means in alignment with the downwardly facing recess means of the top, the bottom having a rearwardly extending wall adjacent to the lower surface and an aperture therethrough for constituting a handle; an exterior cover having an upper edge coupled over the periphery of the top adjacent to its lower surface and coupled over the periphery of the bottom adjacent to its upper surface; and at least one essentially rigid support means with an upper end received within the downwardly facing recess means of the top and with a lower end received within the upwardly facing recess means of the bottom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
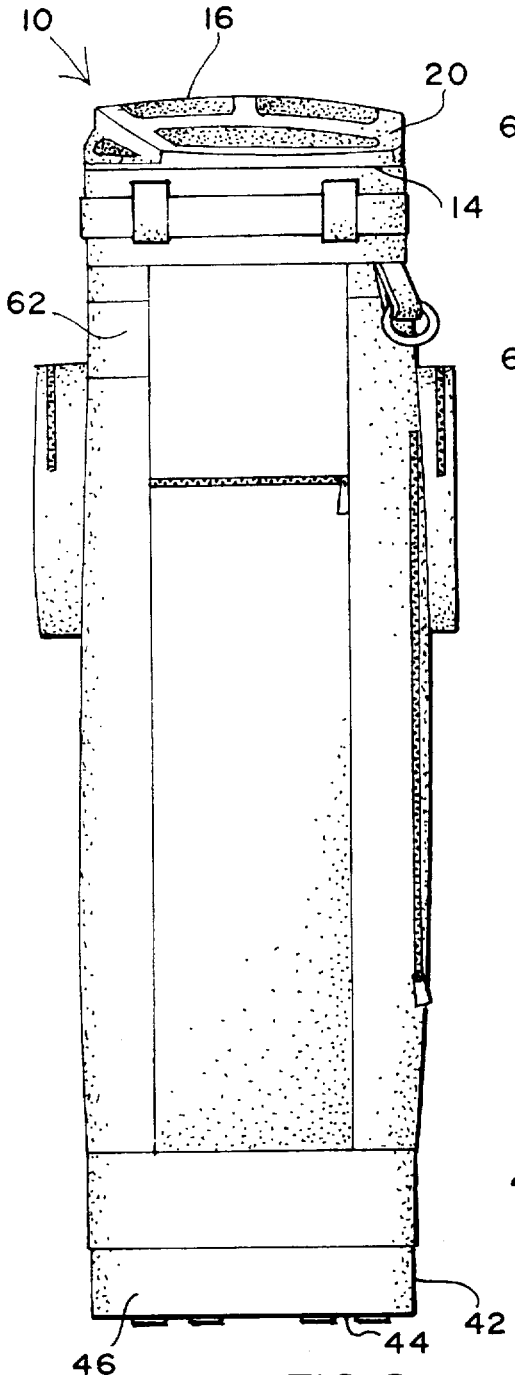
FIG. 2 is a front elevational view of the golf bag shown in FIG. 1.
Figure 1:
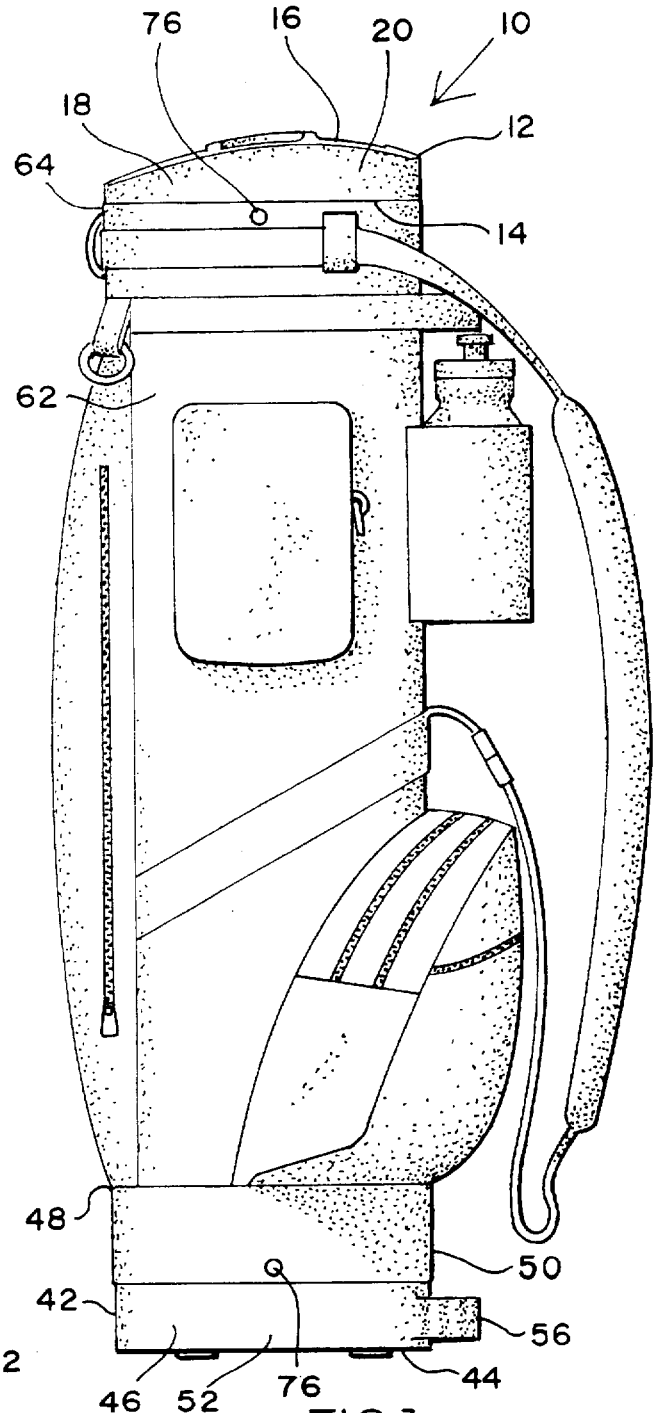
FIG. 1 is a side elevational view of the preferred embodiment of the Golf Bag With Putter Well and Lift Handle constructed in accordance with the principles of the present invention.
Figure 3:
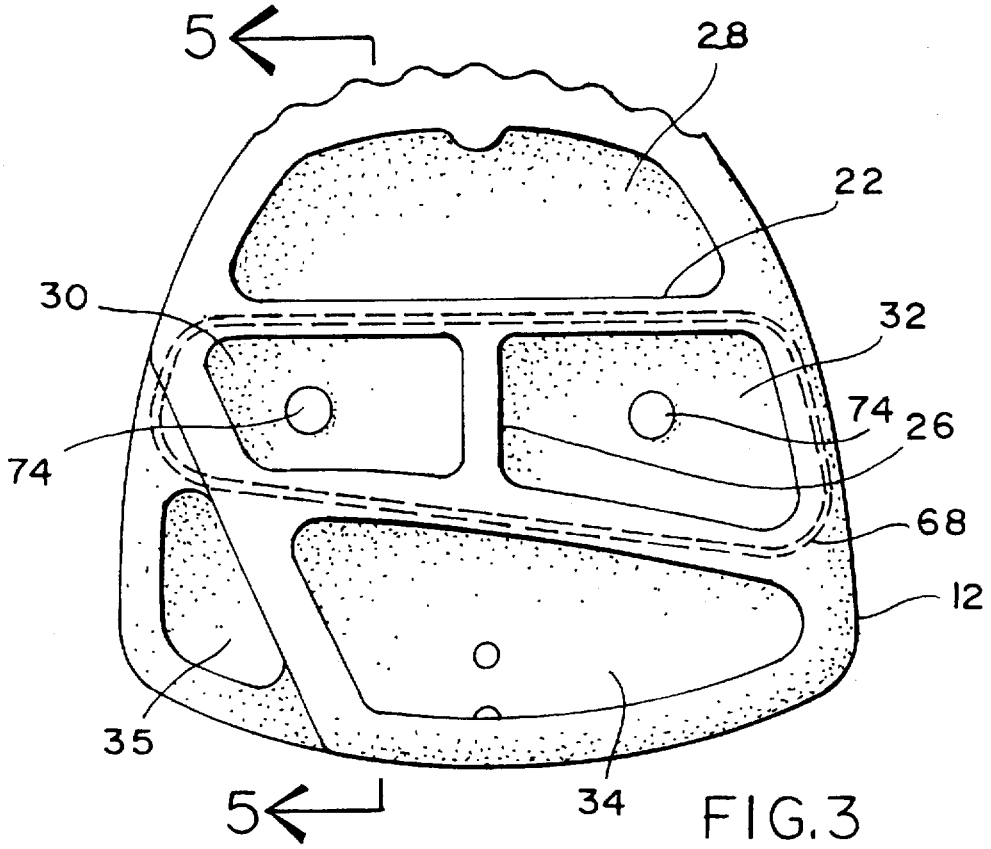
FIG. 3 is a top plan view of the golf bag of the prior Figures.
Figure 4:
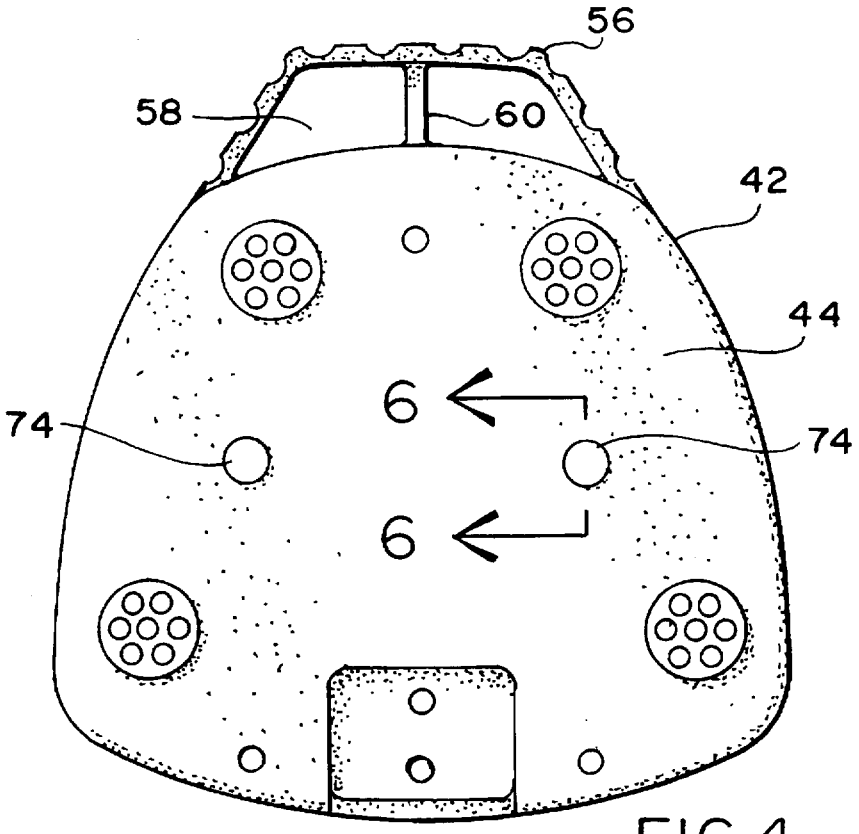
FIG. 4 is a bottom plan view of the golf bag of the prior Figures.
Figure 5:
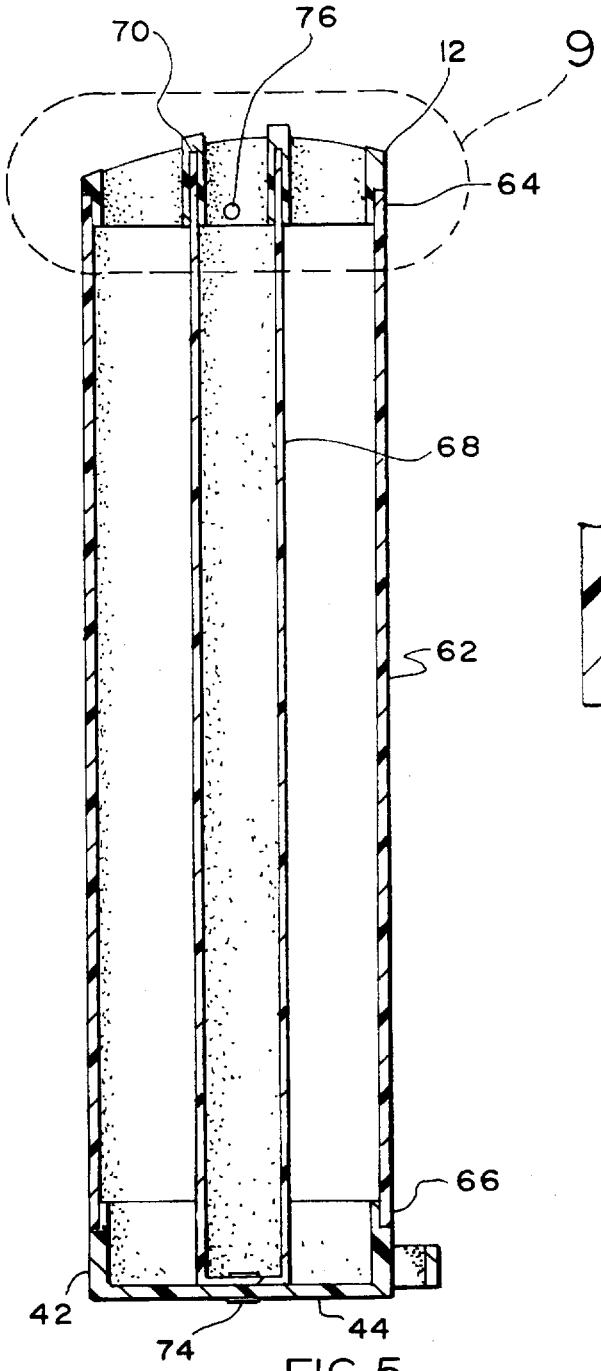
FIG. 5 is cross sectional view taken along line 5—5 of FIG. 3.
Figure 6:
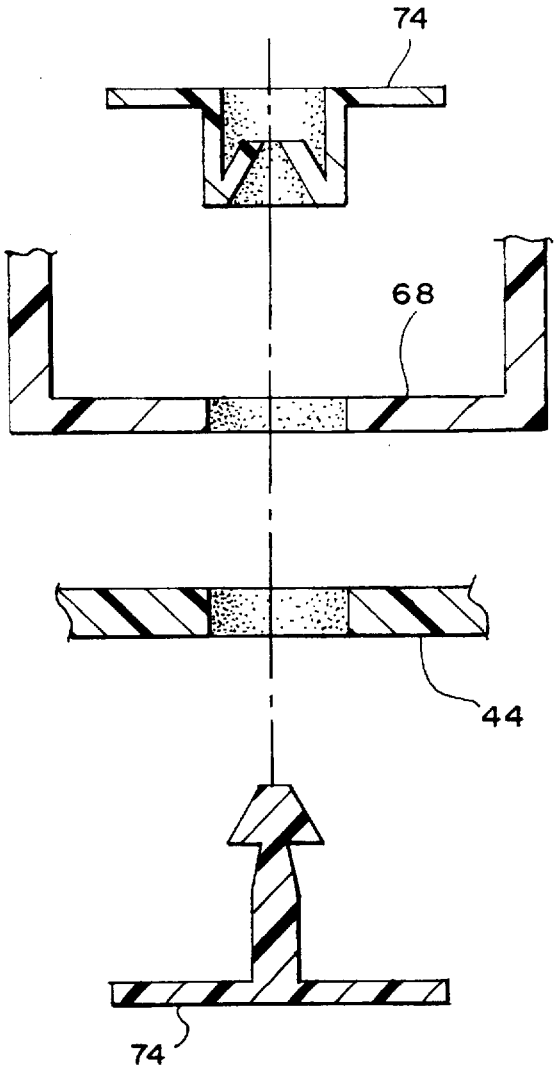
FIG. 6 is cross sectional view taken along line 6—6 of FIG. 4.
Figure 7:
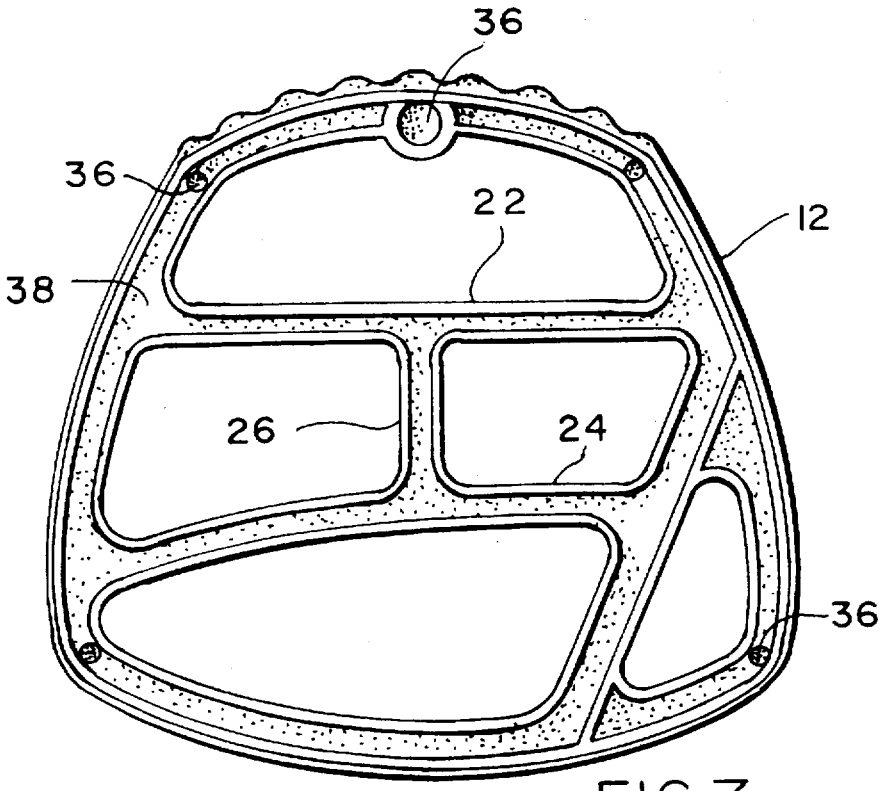
FIG. 7 is a bottom plan view of the golf bag top shown in FIG. 3.
Figure 8:
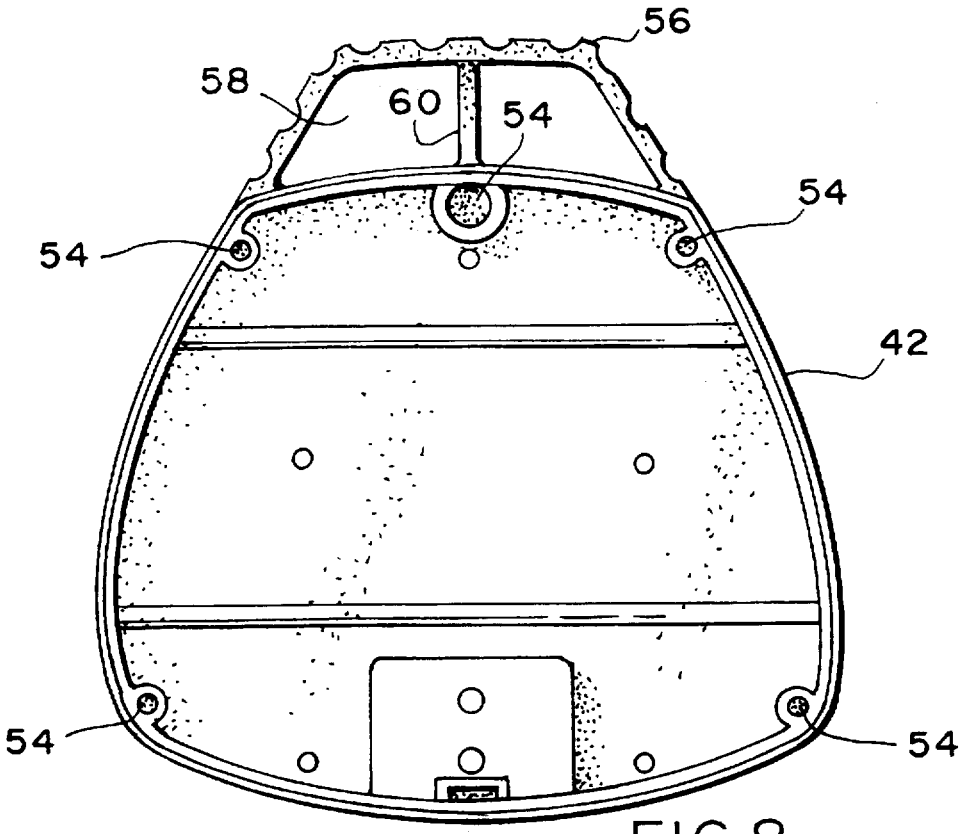
FIG. 8 is a top plan view of the golf bag bottom shown in FIG. 4.
Figure 9:
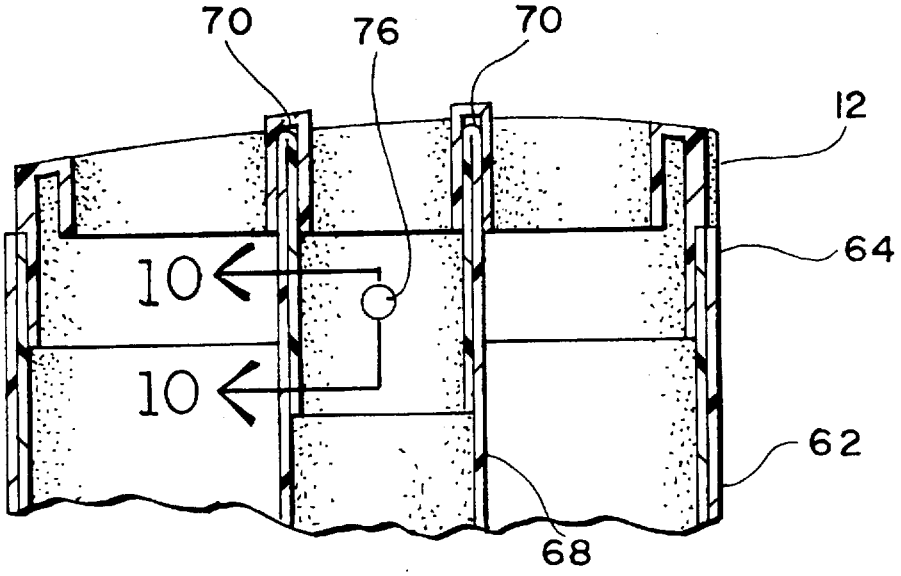
FIG. 9 is an enlarged cross sectional view of the bag taken at oval 9 of FIG. 5.
Figure 10:
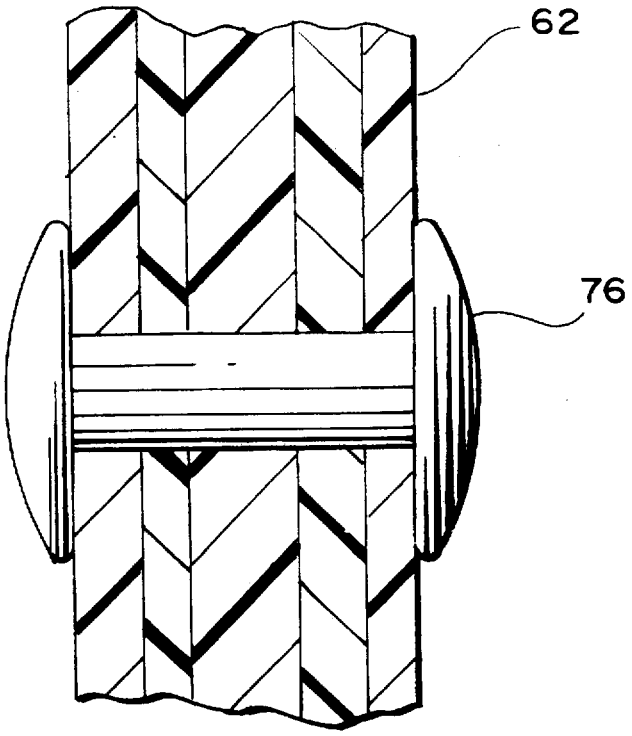
FIG. 10 is a cross sectional view taken along line 10—10 of FIG. 9.
Figure 11:
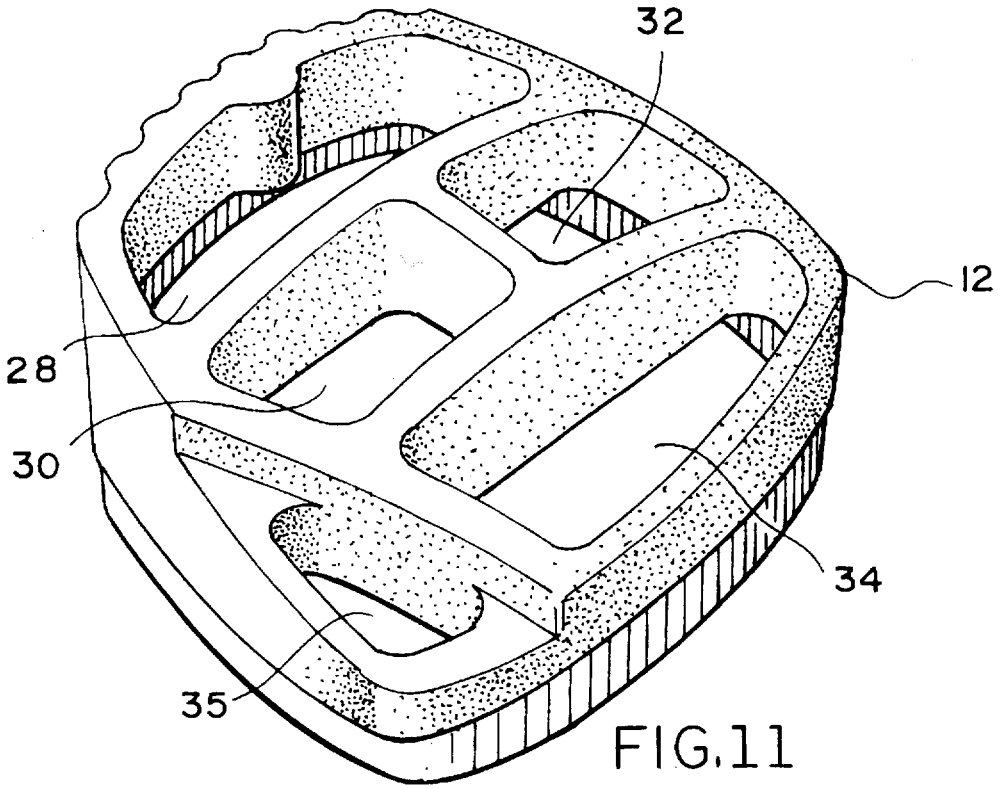
FIG. 11 is a perspective view of the top of the golf bag of the prior Figures.
Figure 12:
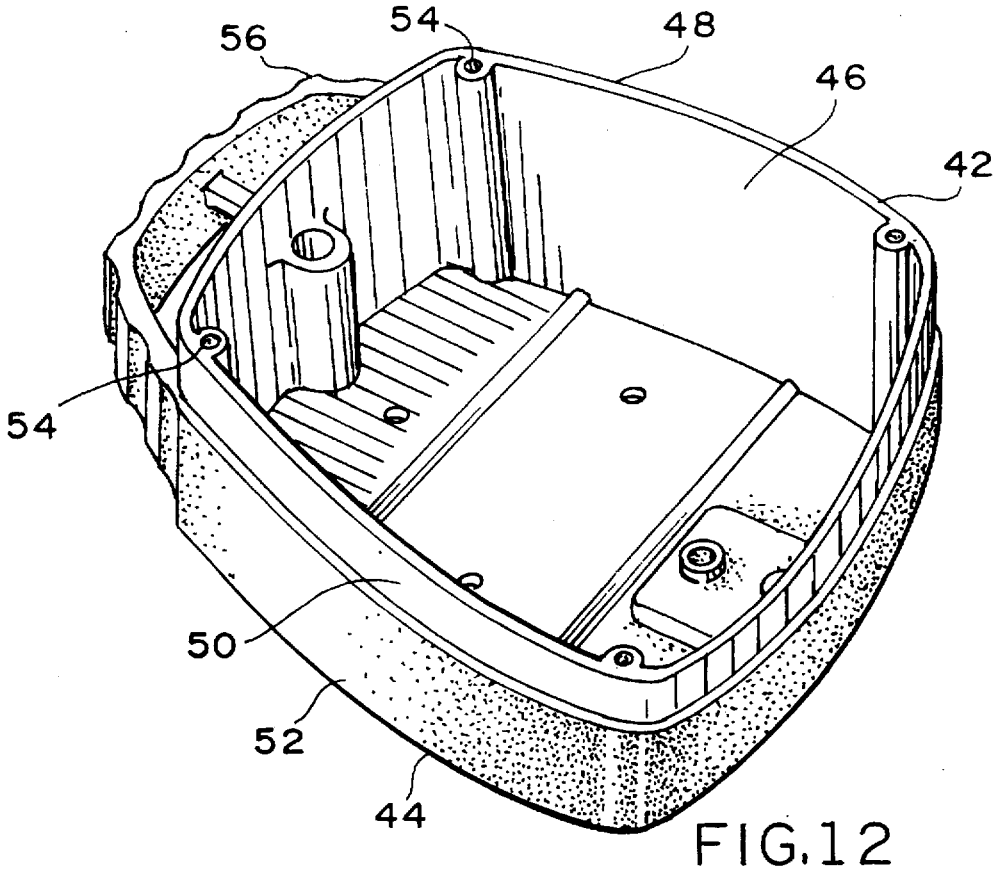
FIG. 12 is a perspective view of the bottom of the golf bag of the prior Figures.

With reference now to the drawings, and in particular to Figures thereof, the preferred embodiment of the new and improved golf bag with putter well and lift handle embodying the principles and concepts of the present invention and generally designated by the reference numeral 10 will be described.

The present invention is comprised of a plurality of components. Such components in their broadest context include a top with a putter well, a bottom with a lift handle, an exterior cover, an interior liner, and rigid rods. Such components are individually configured and correlated with respect to each other so as to attain the desired objective.

More specifically, the golf bag comprises as a major component a top 12 formed in a generally cylindrical configuration. It is preferably fabricated of a thermoplastic rubber for durability and wear resistance without scratching the golf clubs it contacts. The top includes a flat lower surface 14 and a centrally raised upper surface 16. The top is also formed with a lower exterior periphery 18. Such lower periphery is smaller adjacent to the lower surface it is adjacent to than its upper exterior periphery 20 adjacent to its upper surface.

The top is also formed with lateral spacers 22 and 24 and a longitudinal spacer 26. Such spacers form a rear opening 28, two intermediate openings 30 and 32, and a major front opening 34. These openings are at a generally common elevation. Also formed by the spacers is a smaller front opening 35. Such smaller opening constitutes a generally triangular putter well adjacent to one side of the front. The lower surface of the top is formed with five downwardly facing cylindrical apertures 36. Also formed in the top is a downwardly extending elongated recess 38 in the spacers for purposes to be later described.

The next major component of the golf bag of the present invention is the bottom 42. The bottom is preferably formed of polyethylene. Such bottom is formed in a generally cylindrical configuration with a generally flat lower surface 44. The bottom may have downwardly extending projections. The periphery of the wall is upturned to form a peripheral wall 46. Such wall terminates in a flat upper surface 48. The upper exterior periphery 50 of the wall is smaller adjacent the upper surface while the lower exterior periphery 52 of the wall is of a larger size.

The upper surface of the bottom is formed with five upwardly facing cylindrical apertures 54. Such apertures are in axial alignment with, and of a common size as, the downwardly facing cylindrical apertures of the top.

The bottom is formed to include a rearwardly extending, generally trapezoidal wall 56. Such wall is located adjacent to the lower surface but spaced slightly thereabove. It is formed with vertical undulations on its exterior face. It also includes a plurality of apertures 58 therethrough for the passage of a user's fingers thus constituting a handle. The handle has additional support through a vertical rod 60 adapted for coupling the center of the handle with an adjacent region in the bottom. The handle couples to the bottom beneath the upper exterior periphery 50.

The handle adds weight to the bag adjacent to the rear. Similarly, the putter well requires additional material for its spacers adjacent to the front of the bag. The use of a handle and putter well as located within the golf bag of the present invention tends to maintain the proper balance of the golf bag for easier handling.

Next provided is cloth exterior cover 62. Such cover is of any conventional material used for golf bags, natural or synthetic. It is formed in a generally cylindrical configuration. On its exterior are a handle, strap, pockets, etc. of a conventional configuration. The cloth includes an upper edge 64 coupled over the periphery of the top adjacent to its lower surface as by an adhesive. It also includes a lower edge 66 coupled over the periphery of the bottom adjacent to its upper surface as by an adhesive.

An interior fabric liner 68 is next provided. Such liner has an upper edge 70 secured within the downwardly extending elongated recesses of the top. The liner is secured to the bottom with fasteners 74 with outwardly urged segments. There is thus defined within the exterior cover a plurality of compartments. To secure the exterior cover, the interior cover, and the top a plurality of rivets are provided.

Lastly included as part of the golf bag are five essentially rigid rods 78 which function as support means. Each such rod has upper ends. Such upper ends are received within the downwardly facing cylindrical recesses of the top. Each such rod also has lower ends received within the upwardly facing cylindrical recesses of the bottom. The rods function to hold the top and bottom of the bag in proper position to thus give the appropriate form to the cover and thus the entire golf bag. It should be understood that in an alternate embodiment of the invention, the spacing of the top and bottom may be done by other than a plurality of rigid rods. By way of example, such function could be achieved by a single cylindrical tube constituting the exterior periphery of the golf bag, preferably with an exterior sheet material thereover.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf bag with a putter well in the top and a handle in the bottom comprising, in combination:

a top formed of a thermoplastic rubber in a generally cylindrical configuration with a generally flat lower surface and a centrally raised upper surface and with the periphery being smaller adjacent to the lower surface than adjacent to the upper surface, the top being formed with lateral spacers and a longitudinal spacer forming a rear opening, two intermediate openings and a major front opening at a generally common elevation and a smaller front opening at a lower elevation constituting a generally triangular putter well adjacent to one side of the upper surface, the lower surface of the top being formed with a plurality of downwardly facing cylindrical apertures and with a downwardly extending elongated recess in the lateral and longitudinal spacers;

a bottom formed of polyethylene in a generally cylindrical configuration with a generally flat lower surface and a peripheral wall terminating in a generally flat upper surface and with the periphery being smaller adjacent to the upper surface than adjacent to the lower surface, the upper surface of the bottom being formed with a plurality of upwardly facing cylindrical apertures in axial alignment with the downwardly facing cylindrical apertures of the top, the bottom having a rearwardly extending trapezoidal wall adjacent to but located above the lower surface and extending outwardly of the periphery and with radially outwardly extending undulations on its exterior face and an aperture therethrough for constituting a handle, the handle having a radially outwardly extending rod coupling the center of the handle with an adjacent region in the bottom;

a cloth exterior cover in a generally cylindrical configuration having an upper edge coupled over the periphery of the top adjacent to its lower surface and coupled over the periphery of the bottom adjacent to its upper surface;

an interior fabric liner having an upper edge folded over and secured within the downwardly extending elongated recess of the top and secured to the bottom with fasteners to define, within the exterior cover, a plurality of compartments; and a plurality of essentially rigid rods with upper ends received within the downwardly facing cylindrical apertures of the top and with lower ends received within the upwardly facing cylindrical apertures of the bottom.

2. A golf bag comprising:

a top formed in a generally cylindrical configuration with a lower surface and an upper surface, the top being formed with spacers forming openings and with a smaller front opening constituting a generally triangular putter well, the lower surface of the top being formed with at least one downwardly facing recess;

a bottom formed in a generally cylindrical configuration with a lower surface and with a peripheral wall terminating in an upper surface, the upper surface of the peripheral wall being formed with at least one upwardly facing recess in alignment with the downwardly facing recess of the top, the bottom having a wall adjacent to but located above the lower surface and extending outwardly of the peripheral wall and an aperture therethrough for constituting a handle;

an exterior cover having an upper edge coupled over the periphery of the top adjacent to its lower surface and coupled over the periphery of the bottom adjacent to its upper surface; and at least one essentially rigid support with an upper end received within the downwardly facing recess of the top and with a lower end received within the upwardly facing recess of the bottom.

3. The golf bag as set forth in claim 2 wherein the handle includes a radially outwardly extending rod coupling the center of the handle with an adjacent region in the bottom.

4. The golf bag as set forth in claim 2 wherein the top includes a downwardly facing elongated channel in the spacers and further including an interior fabric liner having an upper edge folded over and secured within the downwardly extending elongated channel of the top and secured to the bottom with fasteners to define, within the exterior cover, a plurality of compartments.

5. The golf bag as set forth in claim 2 wherein the putter well is at a lower elevational orientation than the other openings.

* * * * *